US007937768B2

(12) United States Patent
Behrend et al.

(10) Patent No.: US 7,937,768 B2
(45) Date of Patent: May 10, 2011

(54) FLEXIBLE SHIN GUARD

(75) Inventors: Carl Behrend, Portland, OR (US); Thomas DeBlasis, Portland, OR (US); Oliver McLachlan, Chelmsford, MA (US)

(73) Assignee: NIKE, Inc., Beaverton, OR (US)

( * ) Notice: Subject to any disclaimer, the term of this patent is extended or adjusted under 35 U.S.C. 154(b) by 301 days.

(21) Appl. No.: 11/874,248

(22) Filed: Oct. 18, 2007

(65) Prior Publication Data

US 2009/0100563 A1 Apr. 23, 2009

(51) Int. Cl.

| | |
|---|---|
| ***A41D 13/00*** | (2006.01) |
| ***A41D 13/06*** | (2006.01) |
| ***A41D 13/12*** | (2006.01) |
| ***A41D 13/015*** | (2006.01) |
| ***F41H 1/02*** | (2006.01) |
| ***F41H 1/04*** | (2006.01) |

(52) U.S. Cl. ..... 2/22; 2/455; 2/456; 2/24; 2/2.5

(58) Field of Classification Search ..... 2/22, 911, 2/455, 456, 2.5, 24; 128/882; 602/62; D29/120.1, D29/122

See application file for complete search history.

(56) References Cited

U.S. PATENT DOCUMENTS

| | | | | |
|---|---|---|---|---|
| 2,785,407 A | | 3/1957 | Reeder | |
| 3,044,075 A | | 7/1962 | Rawlings | |
| 4,627,108 A | * | 12/1986 | Jarvinen | 2/22 |
| 4,756,026 A | | 7/1988 | Pierce, Jr. | |
| 4,999,847 A | * | 3/1991 | Barcelo | 2/24 |
| 5,125,400 A | * | 6/1992 | Johnson, Jr. | 602/13 |
| 5,384,913 A | | 1/1995 | Hendry | |
| 5,446,926 A | * | 9/1995 | Bourque et al. | 2/22 |
| 5,454,780 A | * | 10/1995 | Duback et al. | 602/8 |
| 5,477,559 A | * | 12/1995 | Clement | 2/22 |
| 5,625,896 A | * | 5/1997 | LaBarbera et al. | 2/22 |
| 5,628,063 A | * | 5/1997 | Reed | 2/22 |
| 5,634,211 A | | 6/1997 | Chen | |
| D381,131 S | | 7/1997 | Duback et al. | |
| 5,652,956 A | * | 8/1997 | Hoshizaki et al. | 2/22 |
| 5,711,028 A | * | 1/1998 | Bourque et al. | 2/22 |
| D392,074 S | | 3/1998 | Witkin | |
| 5,732,411 A | * | 3/1998 | Coleman et al. | 2/22 |

(Continued)

FOREIGN PATENT DOCUMENTS

DE 4128958 3/1993

OTHER PUBLICATIONS

International Search Report and Written Opinion, mailed Feb. 12, 2009, from PCT U.S. Appl. No. PCT/US2008/080088.

(Continued)

*Primary Examiner* — Gary L Welch
*Assistant Examiner* — Jane S Yoon
(74) *Attorney, Agent, or Firm* — Plumsea Law Group, LLC

(57) ABSTRACT

A shin guard includes a plate made of a rigid material sandwiched between two layers of flexible material, such as foam. The two flexible layers are attached to each other around a periphery of at least one of the flexible layers. The plate includes a center panel attached to only one of the flexible material layers. The plate also includes two side panels hingedly attached to the center panel so that the panels can move with respect to the center panel. The panels are not attached to either layer of flexible material so the panels can move with respect to both flexible material layers.

22 Claims, 9 Drawing Sheets

U.S. PATENT DOCUMENTS

| | | | | |
|---|---|---|---|---|
| 5,732,713 | A * | 3/1998 | Duback et al. | 128/846 |
| 5,784,715 | A * | 7/1998 | Buchanan | 2/22 |
| 5,924,140 | A * | 7/1999 | Chi | 2/455 |
| 5,938,630 | A * | 8/1999 | Yen | 602/23 |
| 5,943,695 | A * | 8/1999 | Yen | 2/22 |
| 6,065,152 | A * | 5/2000 | Parker | 2/22 |
| 6,178,556 | B1 | 1/2001 | Foreman et al. | |
| 6,393,610 | B1 * | 5/2002 | Parks | 2/22 |
| 6,490,730 | B1 | 12/2002 | Lyden | |
| 6,595,938 | B1 | 7/2003 | Delmore et al. | |
| 6,681,403 | B2 | 1/2004 | Lyden | |
| 7,003,803 | B1 | 2/2006 | Lyden | |
| 7,082,621 | B1 | 8/2006 | Fratesi | |
| 2005/0114976 | A1 * | 6/2005 | Beland et al. | 2/22 |
| 2006/0005292 | A1 * | 1/2006 | Crye et al. | 2/24 |
| 2006/0179538 | A1 | 8/2006 | Dodd | |

OTHER PUBLICATIONS

International Preliminary Report on Patentability mailed Apr. 29, 2010 in PCT U.S. Appl. No. PCT/US2008/080088.

* cited by examiner

FLEXIBLE SHIN GUARD

BACKGROUND OF THE INVENTION

1. Field of the Invention

The invention relates generally to protective equipment. More particularly, the invention relates to a shin guard having improved flexibility characteristics.

2. Description of Related Art

Athletes in a variety of sports protect themselves against injury by utilizing equipment designed to absorb or cushion impacts. In soccer, for example, shin guards have long been used to prevent bruising of the lower leg when the shin is kicked by another player or is impacted by the ball.

Early shin guards were simply pads or cushioned rigid plates placed within the socks of athletes to cover the front of the shins. Such pads and plates were inconvenient during play, however, as these early shin guards would slip against the leg and migrate toward the ankle, due to the movements of the shin. These early shin guards would then require repositioning or adjustment to prevent irritation to the ankle. If no break in the action were to occur, the player would suffer with the misplaced shin guard until play stopped.

Shin guards having straps or attached socks were then introduced. These shin guards often included a rigid plate with a strap configured to surround the upper calf in order to maintain the position of the shin guard. These shin guards typically included a stirrup that extended underneath the foot. These straps and stirrups helped to maintain the position of the shin guard. However, the increase in positioning stability often resulted in losing degrees of freedom of movement of the shin and calf, as the straps and rigid construction of the plate of the shin guard would inhibit the movements of the leg, particularly the flexing of the muscles of the calf. Such restriction of movement of the calf muscles is particularly problematic in a sport like soccer, where quick cutting agility are required. The desire for maximum freedom of movement of the calf often resulted in players refusing to use shin guards.

Some attempts have been made to provide shin guards that protect the shins while maximizing the flexing capabilities of the calf muscles. These designs typically include removing portions of the rigid plates to reduce the stiffness of the shin guards or hinging the rigid plates to accommodate the natural motion of the calf muscles. However, a need remains for a shin guard capable of protecting the shin while providing improved flexibility characteristics.

SUMMARY OF THE INVENTION

In one aspect, the invention provides a protective leg covering comprising a plate made of a rigid material positioned between a first flexible layer and a second flexible layer, a first portion of the plate being attached to only one of the flexible layers, and a second portion of the plate configured to move with respect to both the first flexible layer and the second flexible layer.

In another aspect, the first flexible layer is fixedly attached to the second flexible layer.

In another aspect, the first flexible layer is fixedly attached to the second flexible layer only along a periphery of one of the flexible layers.

In another aspect, the second portion of the plate is hingedly attached to the first portion of the plate.

In another aspect, the protective leg covering includes a third portion of the plate, the third portion configured to move with respect to the first flexible layer and the second flexible layer.

In another aspect, at least one of the second portion and the third portion is hingedly attached to the first portion.

In another aspect, the second portion is positioned laterally of the first portion and the third portion is positioned medially of the first portion.

In another aspect, the invention provides a shin guard comprising a first foam layer, a second foam layer attached to the first foam layer, a plate made of a rigid material positioned between the first foam layer and the second foam layer, the plate including a center panel and a side panel hingedly attached to the center panel, the center panel being attached to the first foam layer, and the side panel configured to move with respect to the first foam layer and the second foam layer.

In another aspect, the shin guard includes a second side panel hingedly attached to the center panel.

In another aspect, one of the side panels is positioned medially of the center panel and the other side panel is positioned laterally of the center panel.

In another aspect, the center panel is positioned generally over the tibia.

In another aspect, a portion of the center panel protrudes through the first foam layer.

In another aspect, the first foam layer is attached to the second foam layer along a periphery of the first foam layer.

In another aspect, the second foam layer is configured to be removably attached to a shin.

In another aspect, the invention provides a protective leg covering comprising a first flexible layer, a second flexible layer attached to the first flexible layer, a plate made of a rigid material positioned between the first flexible layer and the second flexible layer, the plate including a center panel and a side panel hingedly attached to the center panel, the center panel being attached to one of the first flexible layer or the second flexible layer, and the side panel configured to move with respect to the first flexible layer and the second flexible layer.

In another aspect, the first flexible layer and the second flexible layer comprise a foam material.

In another aspect, the side panel is hingedly attached to the center panel.

In another aspect, the center panel is positioned generally over the tibia.

In another aspect, a second side panel is hingedly attached to the center panel, wherein one of the side panels is positioned laterally of the center panel and one of the side panels is positioned medially of the center panel.

In another aspect, a portion of a front face of the center panel is fixedly attached to the first flexible layer.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention.

Moreover, in the figures, like reference numerals designate corresponding parts throughout the different views.

DETAILED DESCRIPTION OF THE PREFERRED EMBODIMENTS

The invention is generally a protective leg covering having increased flexibility due to a sandwich construction. In a preferred embodiment, the protective leg covering is a shin guard for use by athletes such as soccer players. However, the flexible protective leg covering of the invention may be adapted for use in other sports with modifications to materials and scope of leg coverage, such as protective gear for baseball or softball catchers. Additionally, the protective leg covering may be adapted for use in other industries that utilize protective gear, such as the security and construction fields.

Figure 1:
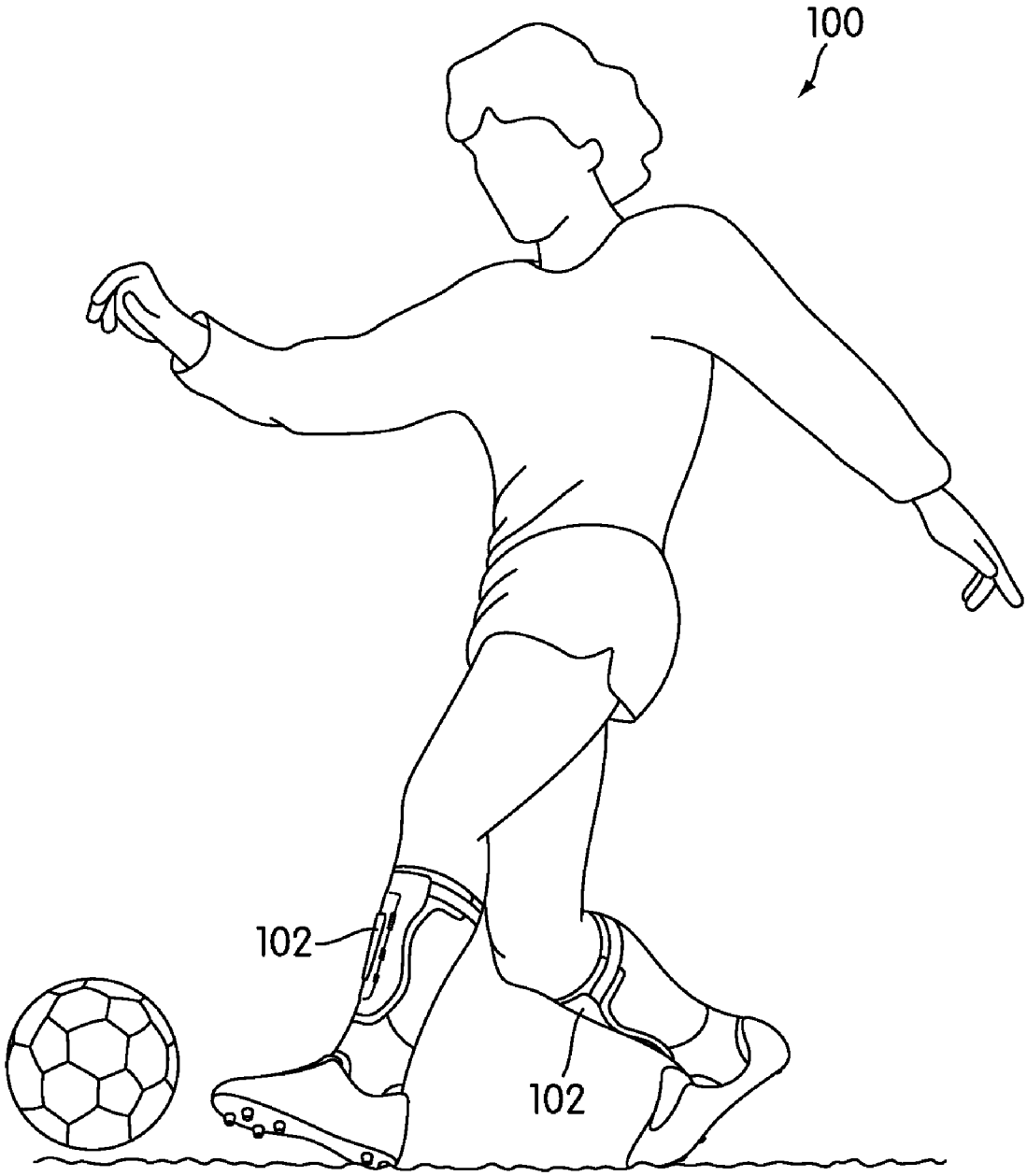
FIG. 1 shows a soccer player wearing a flexible shin guard according to the invention.

FIG. 1 shows a soccer player 100 dribbling a ball on a field while wearing flexible shin guards 102 according to one embodiment of the invention to protect her shins from impact injuries. As player 100 runs, player 100 cuts and weaves across the field in order to avoid having the ball intercepted by a member of the opposing team. Running in general and these cutting motions require the flexing of the muscles of the calf. Shin guard 102 includes provisions to increase the flexibility of shin guard 102 in order to accommodate the flexing of the calf muscles while still protecting the shin from impacts. Furthermore, additional flexibility of shin guard 102 allows shin guard 102 to conform more closely to the shape of the leg, providing a better, more comfortable fit. Shin guard 102 is, therefore, more likely to maintain its original positioning on the leg of player 100, thereby reducing the need for player 100 to adjust the positioning of shin guard 102 during play.

In the embodiment shown in the figures, shin guards 102 are generally symmetrical about a central axis. Therefore, each shin guard 102 may be worn interchangeably on either the right leg or the left leg. In other embodiments, however, shin guards 102 may be asymmetrical, for example, having a smaller medial side than lateral side or vice versa. In such embodiments, any particular shin guard 102 is more comfortably, and more correctly, worn on a specific leg. For the sake of clarity, only one shin guard 102 will be discussed herein, as a symmetrical embodiment is described.

As shown in the figures, shin guard 102 has a sandwich type of construction, with three main layers: a back layer 104, a front layer 106, and a plate 108 positioned between the back layer 104 and the front layer 106. The sandwich construction provides a rigid layer, plate 108, disposed between two flexible and cushioning material layers, back layer 104 and front layer 106, to provide impact resistance and dissipation while remaining flexible and comfortable to wear.

Back layer 104 and front layer 106 are made from flexible materials, such as woven and nonwoven materials capable of being joined together, such as by stitching or with an adhesive. Back layer 104 and front layer 106 may be made of the same material or different materials. Preferably, the material for back layer 104 and front layer 106 is durable and cushioning, so as to absorb multiple impacts of ball and/or foot strikes. In one embodiment, back layer 104 and front layer 106 are made of a foam material, such as EVA or latex foam, or a composite material, such as cloth-reinforced EVA.

The shape of back layer 104 may be any shape capable of covering a portion of the leg of player 100. Back layer 104 may have a generally elongated shape which is contoured to provide maximum coverage of the shin of player 100 while not inhibiting the movement of the leg of player 100. For example, in the embodiment shown in the figures, back layer 104 includes horizontal extensions near the top 101 of back layer 104 in order to accommodate a strap 116 for removably securing shin guard 102 to the leg of player 100. Back layer 104 narrows below these extensions to accommodate the bending of the knee of player 100, then broadens to cover the sides of the calf where the muscle of the calf is largest. Back layer 104 narrows again towards the lower portion 103 of back layer 104 to follow the typical narrowing of the calf towards the ankle. In the embodiment shown in the figures, back layer 104 is a unitary portion of material having no voids to provide maximum coverage and protection of the shin. In other embodiments, however, vent holes may be provided in back layer 104 to increase the breatheability of shin guard 102, which would increase the comfort of shin guard 102 by allowing air to flow between shin guard 102 and the leg of player 100. In such an embodiment, the vent holes in back layer 104 would generally align with eyelets 124 so that the vent extends entirely through shin guard 102 for maximum airflow.

Figure 2:
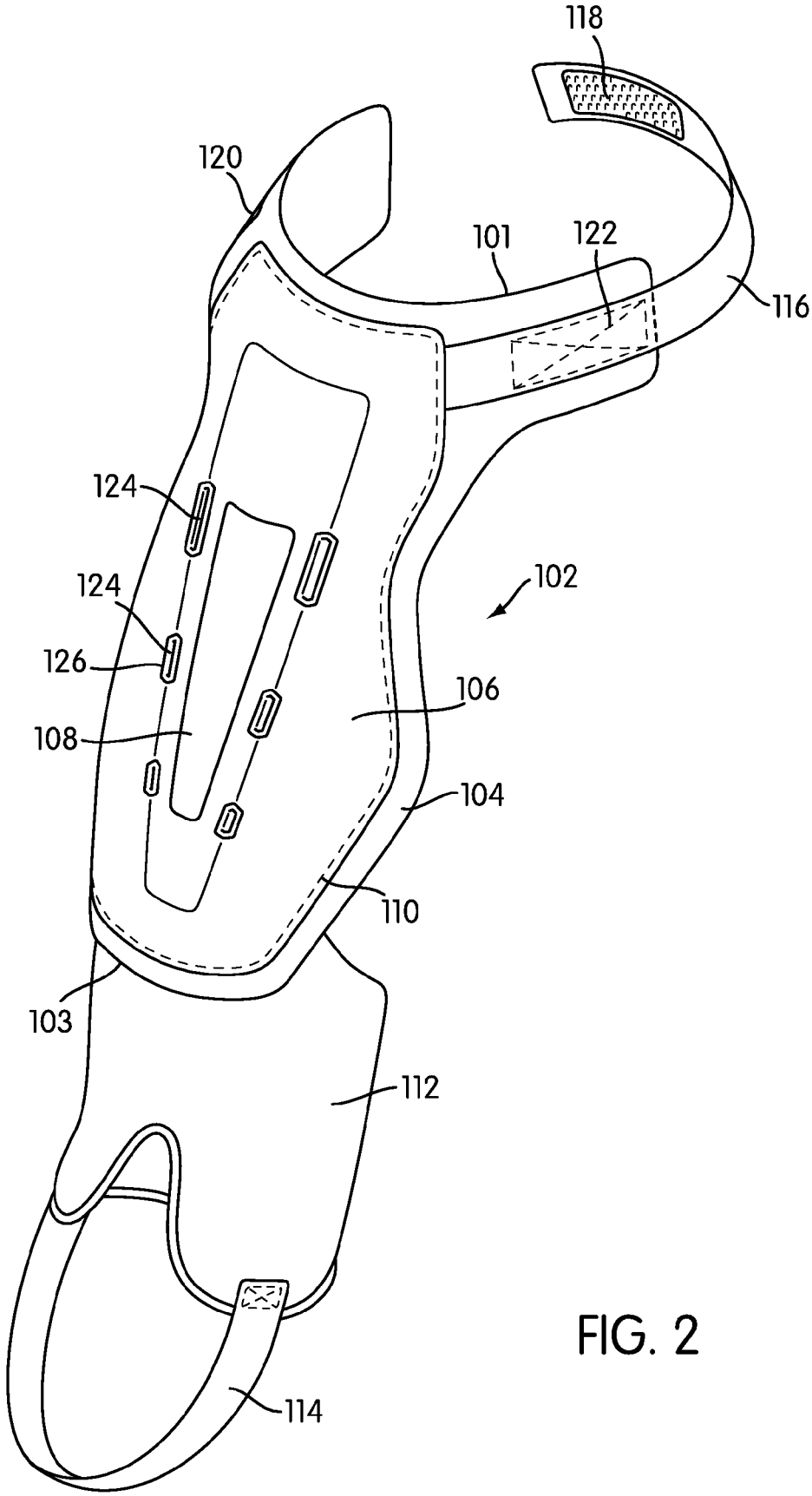
FIG. 2 is a schematic isometric view of a flexible shin guard according to an embodiment of the invention.
Figure 3:
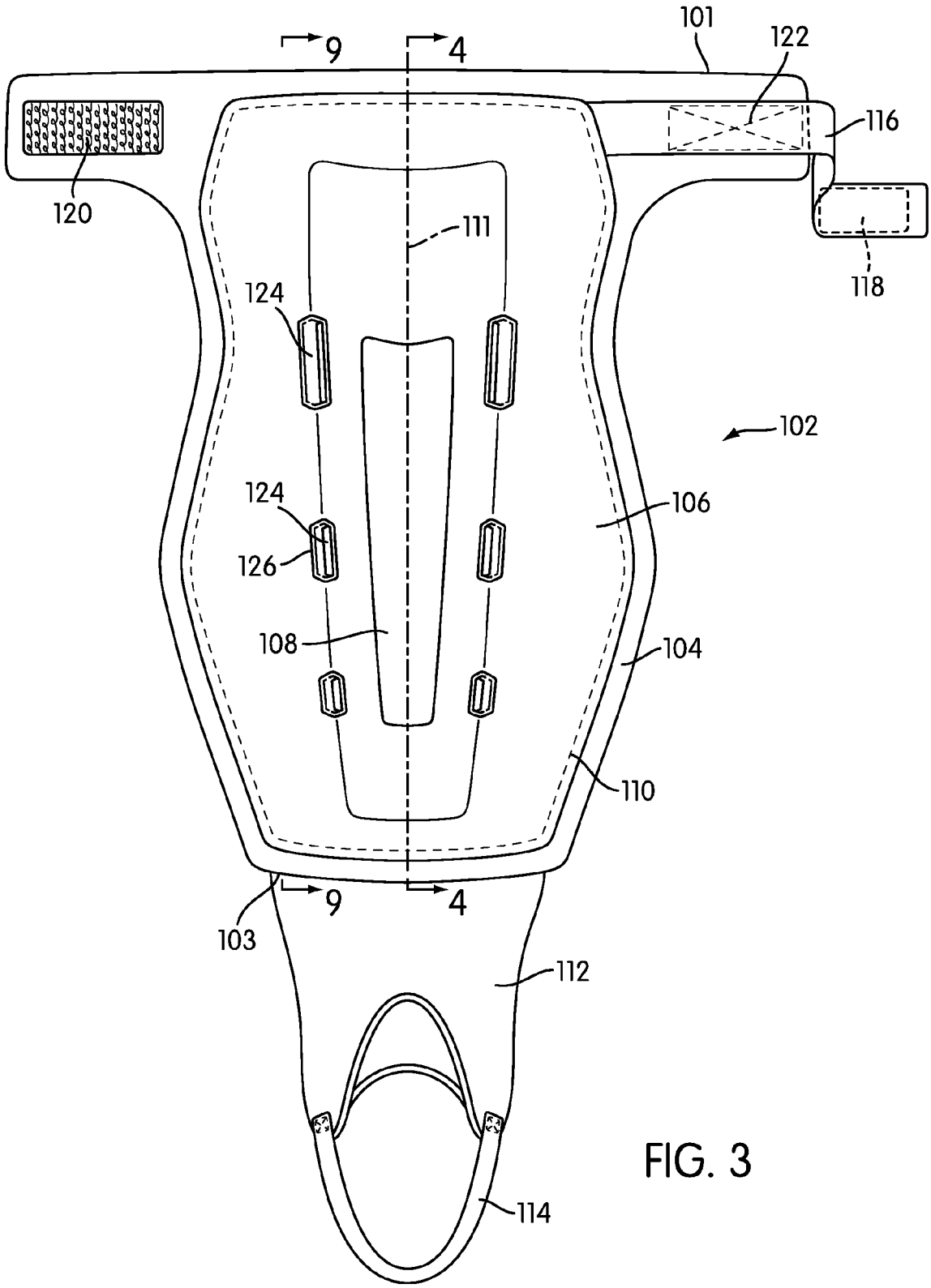
FIG. 3 is a schematic plan view of the flexible shin guard shown in FIG. 2.

Front layer 106 may have the same general size and shape as back layer 104 so that front layer 106 may be readily attached to back layer 104. As best shown in FIGS. 2 and 3, in the embodiment shown in the figures, front layer 106 may also be slightly smaller than back layer 104 and lack the extensions for strap 116. Also, front layer 106 may include two voids or holes, a center hole 142 and multiple eyelet holes 140 to expose portions of plate 108. These exposed portions of plate 108 may be aesthetic, such as the exposure of a window 132 (shown in FIG. 5), or to accommodate additional strapping through eyelets 124.

Figure 4:
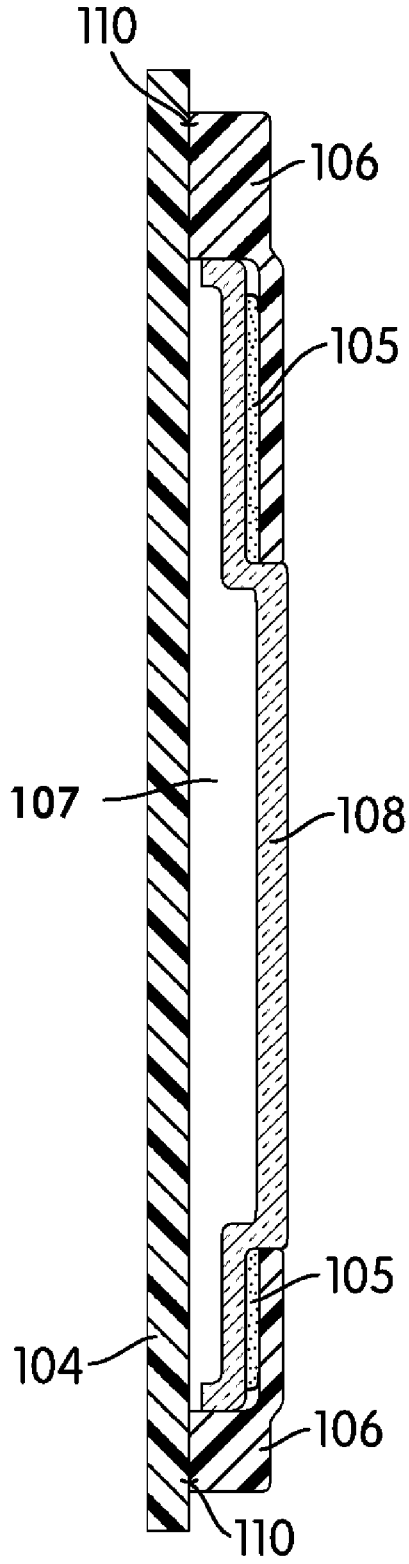
FIG. 4 is a cross-sectional view of the flexible shin guard shown in FIG. 3, taken along line 4-4.
Figure 9:
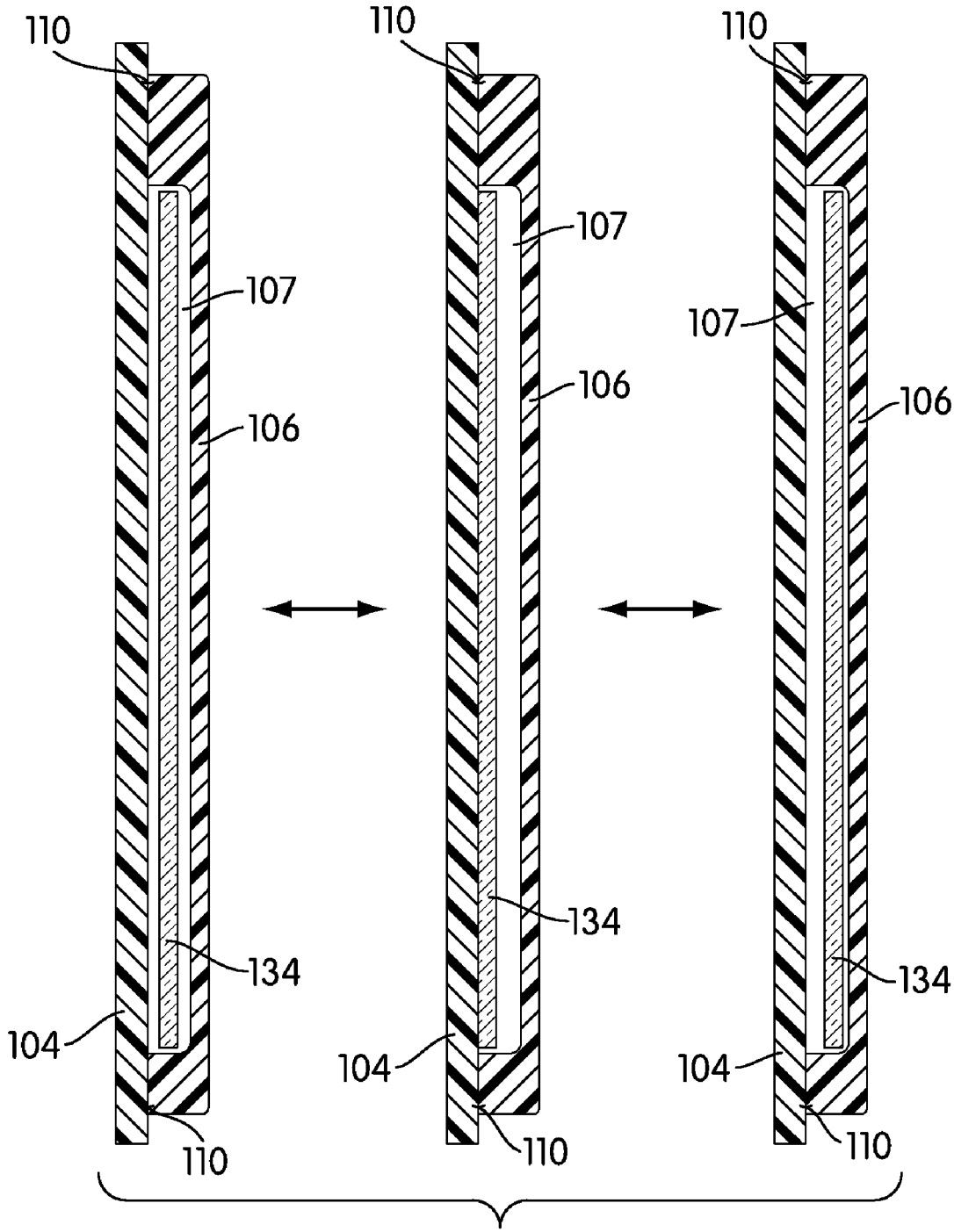
FIG. 9 contains three cross-sectional views of shin guard of FIG. 3, where the flexing of the side panels of the plate within the pocket formed by the foam layers in response to an impact or movement of the calf muscles is shown.

Front layer 106 may be fixedly attached to back layer 104. Preferably, front layer 106 is attached to back layer 104 only around a periphery of front layer 106, so that a pocket or void is formed between layers 104 and 106. Pocket 107 is best shown in FIGS. 4 and 9. Any method known in the art may be used to attach front layer 106 and back layer 104. In the embodiment shown in the figures, stitching 110 is used. In other embodiments, an adhesive or welding may be used.

Plate 108 is preferably inserted into pocket 107. Plate 108 is preferably made from a rigid material capable of absorbing and deflecting the impacts of ball and footstrikes to the shin of player 100. Materials for plate 108 may include composite materials, metals, resins, and plastics. In one embodiment, plate 108 is formed of injection-molded polypropylene or K-Resin© to provide a lightweight but durable rigid layer.

Figure 8:
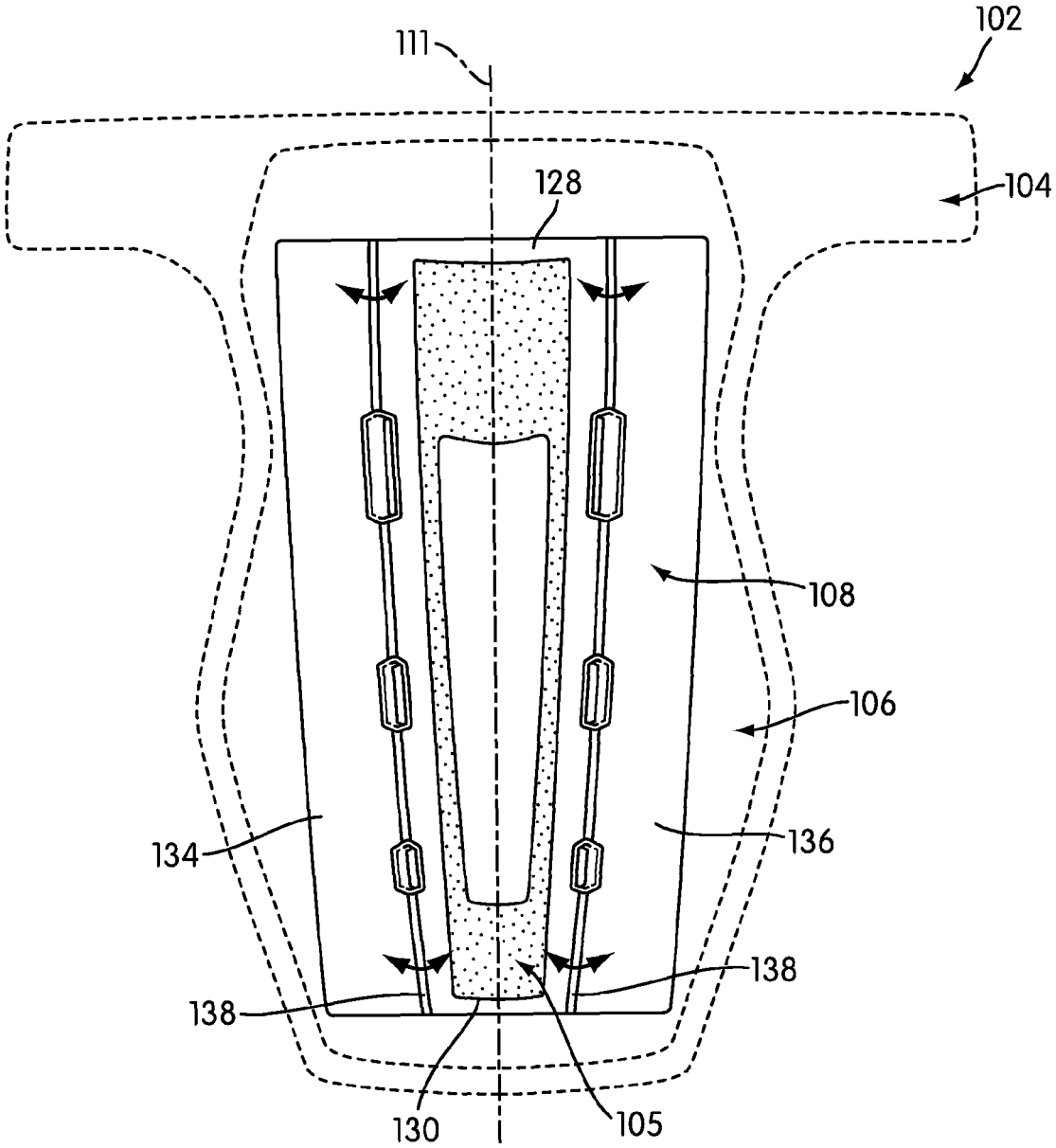
FIG. 8 is a plan view of the shin guard of FIG. 2 with the foam layers shown in phantom to reveal the placement of the plate.

Plate 108 may be shaped and dimensioned to fit entirely within pocket 107, as shown best in FIG. 8. As shown in FIGS. 5-8, plate 108 may have a generally rectangular shape. In order to accommodate the natural shape of the leg of player 100, plate 108 may include a medial-lateral side curvature, as is reflected by the curvature of shin guard 102 in FIG. 2. In other words, plate 108 may be bent around center line 111, shown in FIG. 8, so that side panels 134 and 136 curve away from center panel 128. When center line 111 and center panel 128 are positioned generally over the tibia of the shin, the curvature allows panels 134 and 136 to fit closely to and more effectively cover the sides of the leg of player 100.

Figure 5:
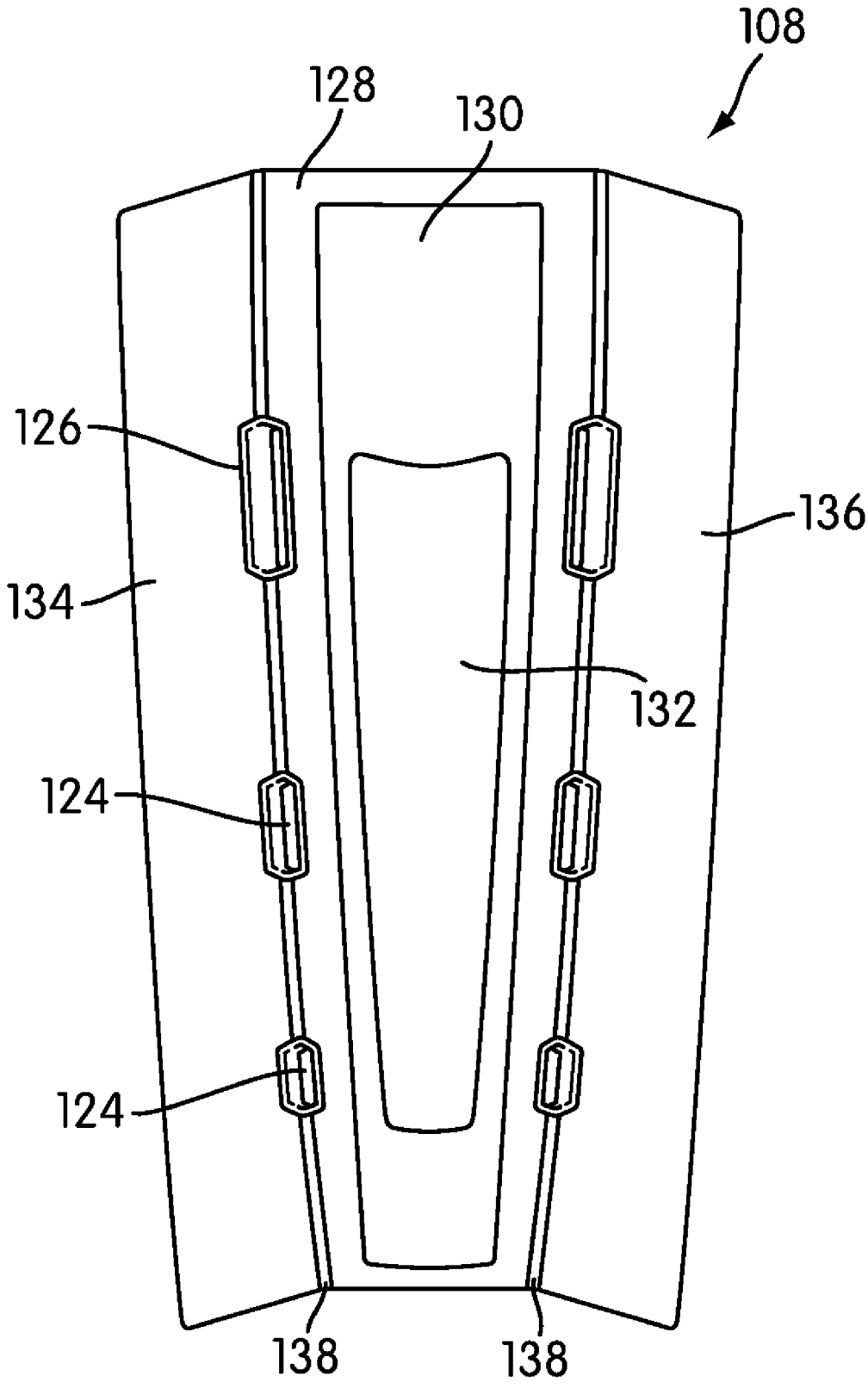
FIG. 5 is a schematic plan view of a rigid plate used in the flexible shin guard.
Figure 6:
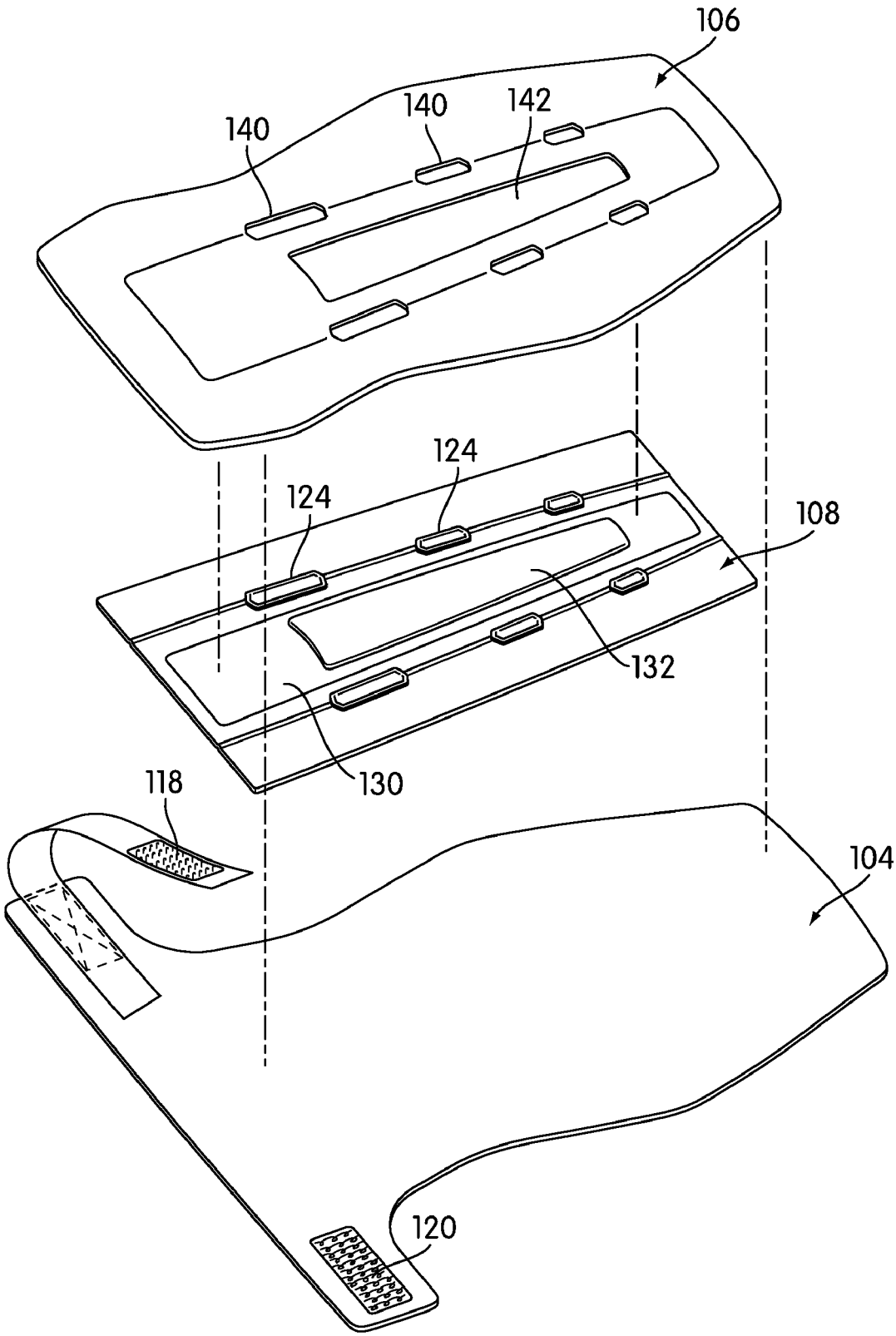
FIG. 6 is an exploded view of the flexible shin guard shown in FIG. 2, with the sock and stirrup removed for clarity.
Figure 7:
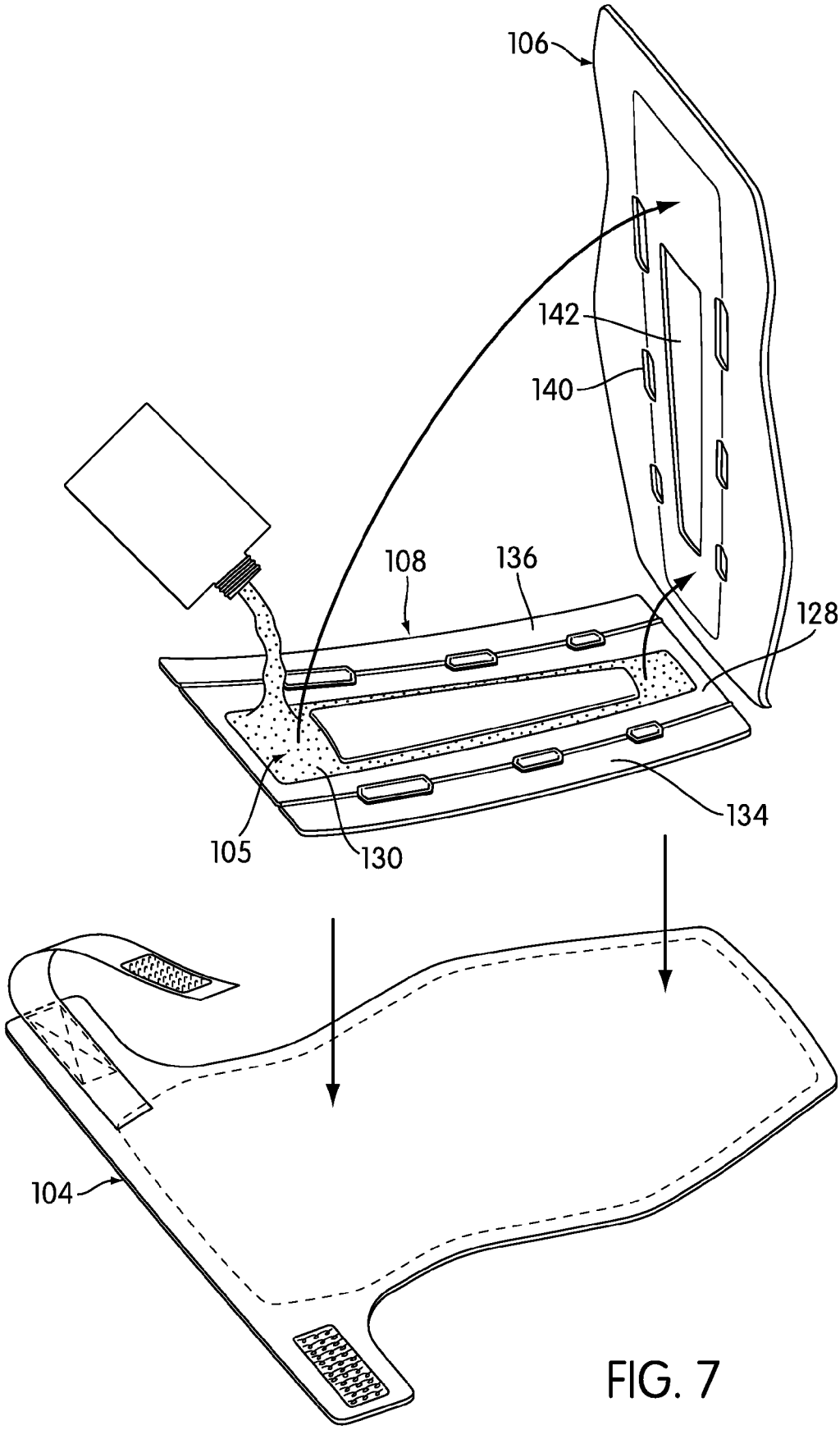
FIG. 7 is a partially assembled view of the flexible shin guard shown in FIG. 2, with the foam layers peeled away from the plate to show the application of the adhesive.

As is best shown in FIGS. 5 and 8, plate 108 may be separated into three general regions: a center panel 128, a first side panel 134, and a second side panel 136. First side panel 134 and second side panel 136 are positioned generally so that one side panel is disposed medially of center panel 128 and the other side panel is disposed laterally of center panel 128. In the embodiment shown in the figures, side panels 134 and 136 are mirror images of each other, so side panels 134 and 136 are interchangeable with each other. In other words, either first side panel 134 or second side panel 136 could be positioned laterally of center panel 128. Similarly, either first side panel 134 or second side panel 136 may be positioned medially of center panel 128. In another embodiment, side panels 134 may be keyed so that shin guard 102 is more comfortably worn on either a right leg or a left leg. For example, in one embodiment, first side panel 134 may be positioned on a lateral side of center panel 128 and second side panel 136 may be positioned on a medial side of center panel 128. In a keyed embodiment, first side panel 134 may be longer, i.e., extend further toward the ankle of player 100, than second side panel 136. In other embodiments, this asymmetry may be reversed.

Additionally, when flexing, first side panel 134 may rub against one or both of back layer 104 and front layer 106. Preferably, therefore, first side panel 134 has a smooth surface and rounded edges to prevent deterioration of back layer 104 and/or front layer 106 due to abrasion.

While the three regions of plate 108 may be formed as a unitary piece with uniform thickness, in one embodiment, flexing hinges 138 are positioned between center panel 128 and side panels 134 and 136. Flexing hinges 138 may be any type of hinge known in the art, such as pivot hinges, bifold hinges, or the like. Preferably, however, flexing hinges 138 are living hinges, such as an area of thinned material, or a material having less stiffness than the panels 128, 134, and 136 of plate 108, where the material may be co-molded with the panels 128, 134, and 136 of plate 108. As shown in FIG. 8, panels 134 and 136 are able to rotate on flexing hinges 138 and move with respect to center panel 128.

As discussed above, plate 108 also includes some elements that may be exposed when shin guard 102 is fully assembled. Window 132 is formed in the middle of center panel 128. Window 132 may protrude through center void 142 in front panel 106. Additionally, one or more eyelets 124 may be provided between center panel 128 and side panels 134 and 136. Eyelets 124 are voids formed in plate 108 and surrounded by a reinforcing rim 126. Eyelets 124 are provided so that additional strapping may be provided and to provide additional ventilation of shin guard 102, particularly when vent holes are provided in back layer 104. Eyelets 124 also reduce the weight and the stiffness of plate 108 by removing material from plate 108. Rim 126 may be made of the same material as plate 108 or different materials, such as those capable of being co-molded or co-formed with plate 108 or those capable of being fixedly attached to plate 108, such as by gluing or welding. Rims 126 reduce the possibility of material failure at eyelets 124 by increasing the thickness of plate 108 in the vicinity of eyelets 124.

While plate 108 would flex at least slightly in response to an impact even without flexing hinges, flexing hinges 138 further reduce the stiffness of plate 108 to increase the flexibility of plate 108. This enhanced flexibility of plate 108 may help to dissipate the energy of an impact, but this increased flexibility also may better accommodate the movement of the muscles of the leg of player 100. If plate 108 were a single rigid piece, the movement of the muscles of the leg of player 100 would be restricted and constrained by the contours of plate 108. With such a plate, the muscles would need to move the entirety of plate 108 to create additional room for flexing. Moving the entire plate with just the flexing of a single muscle could be difficult. A unitary plate 108 could make wearing shin guard 102 uncomfortable or performance-limiting, as the ability to easily cut and maneuver may be limited. With a hinged construction, only a portion of plate 108 need be moved with the flexing of a single muscle. The hinged construction of plate 108 is therefore expected to improve comfort and performance characteristics of shin guard 102.

To even further reduce the stiffness of shin guard 102, plate 108 is preferably loosely secured within pocket 107. Only a portion of plate 108 may be fixedly attached to either or both of back layer 104. Preferably, raised portion 130 of center portion 128 of plate 108 is secured to front layer 106, although in other embodiments, plate 108 may be secured to back layer 104 or the entirety of center portion 128 may be secured to at least one of front layer 106 or back layer 104. By securing plate 108 to front layer 106, plate 108 may move freely with respect to back layer 104. In addition to increasing the overall flexibility of shin guard 102, the ability of plate 108 to move freely with respect to back layer 104 inhibits the transfer of force from plate 108 to back layer 104. This force transfer inhibition makes wearing shin guard 102 more comfortable than traditional shin guards, as shin guard 102 may cushion the blow of impacts more than traditional shin guards.

Raised portion 130 or center portion 128 may be secured to front layer 106 using any type of securing mechanism known in the art, such as a removable mechanism such as a hook-and-loop mechanism. Preferably, however, raised portion 130 or center portion 128 is fixedly attached to front layer 106. In one embodiment, as shown in the FIGS. 4, 7, and 8, raised portion 130 is attached to front layer 106 using an adhesive 105. During assembly, adhesive 105 is applied to raised portion 130, and then raised portion 130 is attached to front layer 106. Front layer 106 is then stitched to back layer 104 around a perimeter of front layer 106 to sandwich plate 108 between front layer 106 and back layer 104.

With this construction, first side panel 134 and second side panel 136 are able to move freely within pocket 107. Reading FIG. 9 from left to right, one possible sequence of movements of first side panel 134 within pocket 107 when shin guard 102 flexes is shown, such as in response to the movement of the calf muscles or when subjected to an impact. Prior to flexing, first side panel 134 may be positioned somewhat in the center of pocket 107, between back layer 104 and front layer 106. During flexing, first side panel 134 may move first toward back layer 104 and then toward front layer 106. After flexing, first side panel 134 may then return to the initial position, centrally disposed within pocket 107 between back layer 104 and front layer 106. First side panel 134 may move through this sequence several times in response to a single impact or muscle movement. As will be recognized by those in the art, first side panel 134 may not have an initial position in the center of pocket 107. First side panel 134 may be shifted toward either front layer 106 or back layer 104. Additionally, pocket 107 may be sized and dimensioned so that plate 108 fits snugly within pocket 107. In such an embodiment, first side panel 134 may abut one or both of back layer 104 and front layer 106 at all times so the first side panel 134 slides or rubs against one or both of back layer 104 when moving within pocket 107.

As second side panel 136 is preferably substantially similar to first side panel 134, the movement of second side panel 136 within pocket 107 is also similar to the movement of first side panel 134 described above.

Shin guard 102 may be worn by player 100 independently of socks, as shin guard 102 includes provisions to removably attach shin guard 102 to the leg of player 100. For example, as shown in FIGS. 2 and 3, shin guard 102 is provided with an adjustable strap 116 configured to extend around the calf, such as near the knee of player 100. Player 100 may then optionally pull a sock over shin guard 102. In other embodiments, shin guard 102 may be configured to be worn only with socks, such as by inserting shin guards 102 into socks.

Adjustable strap 116 may be made of any flexible material known in the art, but if preferably made of an elastic material. Adjustable strap 116 is preferably fixedly attached to shin guard 102 at a first end, such as with stitches at an anchoring point 122. A second end of adjustable strap 116 may be free, so that adjustable strap 116 may be extended around the leg of player 100 and then removably secured to shin guard 102. Adjustable strap 116 may be removably secured to shin guard 102 using any securing mechanism known in the art, such as with snaps, buckles, or the like. In the embodiment shown in FIGS. 2 and 3, a hook-and-loop system, such as Velcro®, is used to removably attach the free end of adjustable strap 116 to shin guard 102. A first portion 118 of the securing mechanism is fixedly attached to the free end of adjustable strap 116. A coordinating portion 120 of the securing mechanism is fixedly attached to shin guard 102. The two portions 118 and 120 are configured to engage with each other when pressed together and to separate when peeled apart. Coordinating portion 120 may be positioned on a lateral side of shin guard 102, to prevent the unintentional separation of portions 118 and 120 if the legs of player 100 were to run together.

To secure a lower portion 103 of shin guard 102 to the leg of player 100, a second adjustable strap like adjustable strap 116 may be provided. In the embodiment shown in FIGS. 2 and 3, however, a sock portion 112 is attached to lower portion 103. Sock portion 112 is configured so that the foot of player 100 may be passed through sock portion 112 so that sock portion 112 resides around an ankle or lower shin of player 100. Sock portion 112 is preferably a tubular sleeve of flexible material, such as an elastic woven natural or synthetic material. One end of sock portion 112 may be fixedly attached to lower portion 103 using any method known in the art, such as by stitching, with an adhesive, or co-forming with a portion of shin guard 102, for example, as an extension of back layer 104.

Sock portion 112 also preferably includes a stirrup 114 configured to pass underneath the foot to prevent shin guard from riding up the leg when player 100 runs. Stirrup 114 may be made of any material capable of resisting upward motion of shin guard 102. To increase comfort, stirrup 114 may be made of a flexible material, such as natural or synthetic cloth, foam, or the like. Stirrup 114 may be fixedly attached to sock portion 112 on a medial side and a lateral side of sock portion 112 using any method known in the art, such as with an adhesive or by stitching. In other embodiments, stirrup 114 may be removably attached to sock portion 112 on one or both sides of sock portion 112.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A protective leg covering comprising:

a plate made of a rigid material positioned between a first flexible layer and a second flexible layer;

the plate having a center panel and a side panel, wherein a living hinge associates the center panel with the side panel so that the center panel is continuous with the side panel;

a first entirely rigid portion of the plate being permanently attached to and in direct contact with only one of the flexible layers;

a second entirely rigid portion of the plate configured to move with respect to both the first flexible layer and the second flexible layer; and multiple protrusions located between the first portion and the second portion, each protrusion positioned proximate the living hinge and extending through at least one of the flexible layers.

2. The protective leg covering according to claim 1, wherein the first flexible layer is permanently attached to the second flexible layer.

3. The protective leg covering according to claim 2, wherein the first flexible layer is permanently attached to the second flexible layer only along a periphery of one of the flexible layers.

4. The protective leg covering according to claim 1, wherein the side panel is configured to move freely with respect to the first flexible layer and the second flexible layer.

5. The protective leg covering according to claim 1 further comprising a third portion of the plate, the third portion configured to move with respect to the first flexible layer and the second flexible layer.

6. The protective leg covering according to claim 5, wherein the third portion comprises a second side panel, wherein a living hinge associates the center panel with the second side panel so that the center panel is continuous with the second side panel.

7. The protective leg covering of claim 1, wherein each protrusion of the multiple protrusions constitutes a raised rim surrounding a through-hole eyelet, the rim extending through at least one of the flexible layers.

8. A protective leg covering comprising:

a plate made of a rigid material positioned between a first flexible layer and a second flexible layer;

the plate having a center panel and a side panel, wherein a living hinge associates the center panel with the side panel so that the center panel is continuous with the side panel;

a first entirely rigid portion of the plate being permanently attached to only one of the flexible layers;

a window formed in the center panel, wherein the first portion surrounds a periphery of the window and the window protrudes through a center portion of at least one of the flexible layers;

a second entirely rigid portion of the plate configured to move with respect to both the first flexible layer and the second flexible layer; and multiple through-hole eyelets located between the first portion and the second portion, each eyelet having a raised rim that extends through at least one of the flexible layers.

9. A shin guard comprising:

a first foam layer;

a second foam layer attached to the first foam layer;

a plate made of a rigid material positioned between the first foam layer and the second foam layer;

the plate including a center panel and a side panel hingedly attached to the center panel;

a first portion of the center panel being adhered to the first foam layer, wherein a second portion of the center panel protrudes through a center of the first foam layer;

the side panel configured to move with respect to the first foam layer and the second foam layer, a second side panel hingedly attached to the center panel, and wherein one of the side panels is positioned medially of the center panel and the other side panel is positioned laterally of the center panel.

10. The shin guard according to claim 9, wherein the side panel is associated with the center panel with a first living hinge and the second side panel is associated with the center panel with a second living hinge.

11. The shin guard according to claim 9, wherein the second side panel is configured to move with respect to the first foam layer and the second foam layer.

12. The shin guard according to claim 11, wherein the center panel is configured to be positioned generally over a tibia.

13. The shin guard according to claim 9, wherein the first foam layer is attached to the second foam layer along a periphery of the first foam layer.

14. The shin guard according to claim 9, wherein the second foam layer is configured to be removably attached to a shin.

15. A shin guard comprising:

a first foam layer;

a second foam layer attached to the first foam layer;

a plate made of a rigid material positioned between the first foam layer and the second foam layer;

the plate including a center panel and a side panel hingedly attached to the center panel;

the center panel being permanently attached to the first foam layer, wherein a portion of the center panel protrudes through the first foam layer;

the side panel configured to move with respect to the first foam layer and the second foam layer, a second side panel hingedly attached to the center panel, and wherein one of the side panels is positioned medially of the center panel and the other side panel is positioned laterally of the center panel; and a window formed in the center panel, and wherein the window protrudes through a center of the first foam layer.

16. A protective leg covering comprising:

a first flexible layer;

a second flexible layer attached to the first flexible layer to form a pocket between the first flexible layer and the second flexible layer;

a plate made of a rigid material positioned within the pocket;

the plate including an entirely rigid center panel and an entirely rigid side panel hingedly attached to the center panel, wherein both the center panel and the side panel are positioned within the pocket;

the center panel being permanently attached to only one of the first flexible layer or the second flexible layer; and the side panel configured to move within the pocket.

17. The protective leg covering according to claim 16, wherein a first portion of the center panel is permanently attached to the first flexible layer, and wherein a second portion of the center panel is able to move freely with respect to the first flexible layer.

18. The protective leg covering according to claim 17, wherein the center panel is configured to be positioned generally over a tibia, and wherein the second layer is configured to abut a shin when worn, and wherein the plate moves freely with respect to the second layer to inhibit the transfer of force from the plate to the shin.

19. The protective leg covering according to claim 18 further comprising a second side panel hingedly attached to the center panel, wherein one of the side panels is positioned laterally of the center panel and one of the side panels is positioned medially of the center panel.

20. The protective leg covering according to claim 16, wherein the first flexible layer and the second flexible layer comprise a foam material.

21. A protective leg covering comprising:

a first flexible layer;

a second flexible layer attached to the first flexible layer to form a pocket between the first flexible layer and the second flexible layer;

a plate made of a rigid material positioned within the pocket;

the plate including a center panel and a side panel hingedly attached to the center panel, wherein both the center panel and the side panel are positioned within the pocket;

the center panel being permanently attached to one of the first flexible layer or the second flexible layer;

the side panel configured to move within the pocket;

wherein a first portion of the center panel is permanently attached to the first flexible layer, and wherein a second portion of the center panel is able to move freely with respect to the first flexible layer; and a window formed in the center panel, wherein a periphery of the window is surrounded by the first portion of the center panel, and wherein the first portion of the center panel is permanently attached to the first layer so that the window protrudes through a void formed in a center of the first layer.

22. The protective leg covering of claim 21, wherein the first portion of the center panel is permanently attached to the first layer around an entirety of the periphery of the window.

* * * * *